US006519347B1

(12) United States Patent
Morecroft et al.

(10) Patent No.: US 6,519,347 B1
(45) Date of Patent: Feb. 11, 2003

(54) PANEL-FORM LOUDSPEAKERS

(75) Inventors: Denis Morecroft, Cambridgeshire (GB); Neil Harris, Cambridge (GB)

(73) Assignee: New Transducers Limited, London (GB)

( * ) Notice: Subject to any disclaimer, the term of this patent is extended or adjusted under 35 U.S.C. 154(b) by 0 days.

(21) Appl. No.: 09/475,031

(22) Filed: Dec. 30, 1999

Related U.S. Application Data

(63) Continuation of application No. PCT/GB98/01913, filed on Jun. 30, 1998.

(30) Foreign Application Priority Data

Jul. 3, 1997 (GB) ..... 9714050

(51) Int. Cl.[7] ..... H04R 25/00
(52) U.S. Cl. ..... 381/152; 381/431
(58) Field of Search ..... 381/152, 431, 381/423, 424, 425, 412, 413, 419, 420, 407

(56) References Cited

U.S. PATENT DOCUMENTS 3,509,290 A * 4/1970 Mochida et al. ..... 381/431
3,569,638 A * 3/1971 Schoengold ..... 381/409
3,801,943 A * 4/1974 Bertagni ..... 381/398
4,322,583 A * 3/1982 Maeda ..... 381/425
4,488,012 A * 12/1984 Matsuda et al. ..... 381/96
5,818,950 A * 10/1998 Sakamoto et al. ..... 381/201
6,151,402 A * 11/2000 Azima et al. ..... 381/396
6,192,136 B1 * 2/2001 Azima et al. ..... 381/338

FOREIGN PATENT DOCUMENTS

| | | |
|---|---|---|
| WO | WO 97/09858 | 3/1997 |
| WO | WO 97/09859 | 3/1997 |
| WO | WO 97/09861 | 3/1997 |

OTHER PUBLICATIONS

Patent Abstracts of Japan, vol. 007, No. 080 (E–168), Apr. 2, 1983 & JP 58 008000 (Murata Seisakusho:KK), Jan. 17, 1983.

* cited by examiner

*Primary Examiner*—Sinh Tran
(74) *Attorney, Agent, or Firm*—Foley & Lardner

(57) ABSTRACT

A loudspeaker comprises a panel member (11, 21, 31, 41, 61, 71, 81, 91) as resonant acoustic radiator relying on bending wave action and a driver (12, 22, 32, 42, 62, 72, 82, 92) coupled to the panel member to cause bending waves therein. The panel member has its mass and/or bending capability of the panel member locally altered or otherwise different, particularly locally of the driver as coupled to the panel member. Local holes (16, 26, 36, 46), affixed mass (66) or affixed damping material (76) are effective to reduce high frequency due to drumming effects at the driver coupling (17, 37, 47, 67, 77, 87).

31 Claims, 6 Drawing Sheets

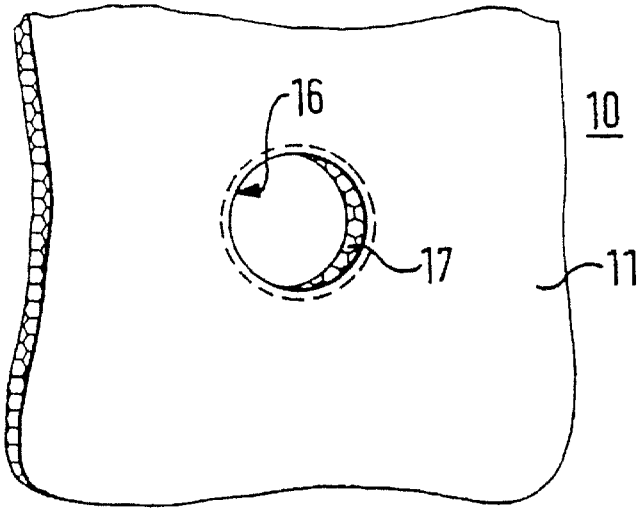
FIG. 1A
FIG. 1B
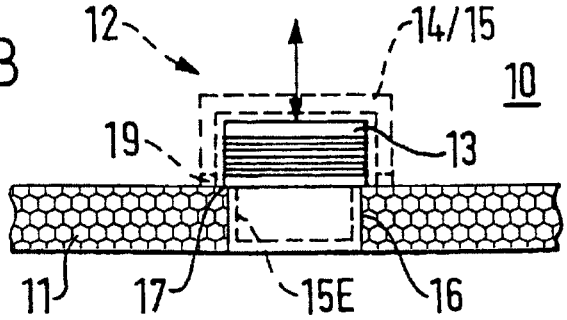
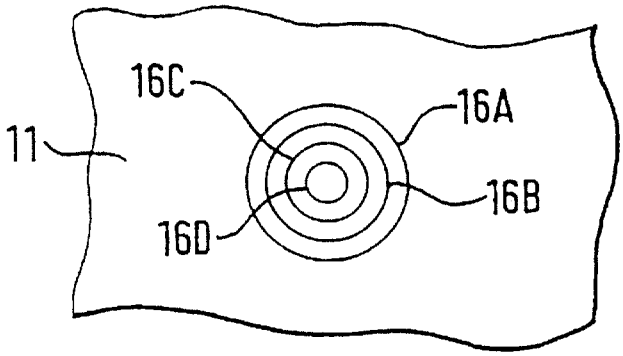
FIG. 1C

PANEL-FORM LOUDSPEAKERS

This application is a continuation of International application No. PCT/GB98/01913, filed Jun. 30, 1998.

DESCRIPTION

Field of the Invention

This invention relates to acoustic devices for which acoustic performance relies on bending wave action and related beneficial areal distribution of resonant modes of surface vibration.

For first teaching regarding such resonant mode acoustic devices, particularly as panel-form members, reference is directed to International Patent Application WO97/09842; or its U.S. equivalent, application Ser. No. 08/707,012, filed Sep. 3, 1996 and various later patent applications by New Transducers Limited before this patent application make useful additions and developments, including as to viable variations of transducer location(s) and/or panel distribution (s) of bending structure/geometry and/or stiffness and/or mass.

This invention arises particularly in relation to loudspeakers using such panel-form members as acoustic radiators.

BACKGROUND TO THE INVENTION

A typical panel-form loudspeaker comprises a distributed mode acoustic radiation member having a moving coil drive unit to impart bending waves to the panel by push-pull action applied to the surface of the panel. The typically circular section voice coil of the drive unit exerts force by its end in circumferential, contact with the panel member. A typically circular zone of the panel member effectively within the voice coil sectional area can both resist desired formation of bending waves in the panel member, and itself vibrate to produce acoustic output components at high frequencies by way of drum-like action ("drumming").

DISCLOSURE OF THE INVENTION

It is an object of the invention to aid useful coupling between drive units and panel members of loudspeakers either to decrease resistance to bending wave formation or to reduce high frequency drumming, ideally both further hopefully usefully to increase and/or smooth energy input and/or frequency response/output.

According to one aspect of the invention a loudspeaker comprises a panel-form member as resonant acoustic radiator and a driver coupled to the member to apply bending waves thereto, and is characterised in that the panel member is altered or different locally of the driver as coupled to the panel member in a manner involving mass and/or bending capability.

The alteration or difference in mass and/or bending capability may be within the confines or area of the coupling of the driver to the panel member, and may be concentric with the driver.

Localised reduction of mass and/or bending resistance may be achieved by removal or absence of portion(s) of the panel member. At least one hole made in or through the panel member may be of substantially constant or tapered cross-section; or the hole may be mis-matched to the coupled end of the driver, as the voice coil of magnet-and-moving coil type said driver, to facilitate spaced connections of said coupling, such as in our co-pending UK patent application GB 19709438.

Such a hole through the panel member within the area of the driver, typically voice coil coupling removes panel material which could otherwise resonate in drum-like manner. Such a hole also militates against what could otherwise effectively be stiffening by the driver coupling. Efficiency of power transfer into the panel member may be usefully increased. Reduction of mass of the panel member near the voice coil, and the presence of an "edge" within the excitation area can assist bending wave formation and acoustic radiation, with effective reduction of unwanted high frequency content from drumming effects. Diffraction resulting from such a hole/edge can be reduced by various means including extending the drive unit pole piece into the hole, or adding other material to the pole piece, say to make it level with the panel surface.

Such a hole can allow the possibility of fixing the voice coil former right through the panel member, skin-to-skin, to increase the strength of fixing bond and to allow higher powers to be applied to the panel member without damaging the structure.

The hole in the panel member if non-parallel sided, typically conical tapered from one panel side, can, if of less than full thickness of the panel member, be nondamaging to the cosmetic appearance of the other side, say front, of the panel member.

Suitable apertures or holes in the panel member, particularly through the area of driver coupling thereto, may range up to cross-sectional size of the vibration-inducing driver component, usually voice coil. Different hole sizes produce different upward shifts of unwanted high frequencies arising from drumming, thus enable extension of acoustic working frequency range to desired extent of reduction of intrusion/content from drum-like vibration.

The alteration or difference in mass and/or bending capability of the panel member may be by way of affixing an additional mass that may be on either or both sides of the panel member within the area of the driver, typically voice coil, coupling. Such additional mass may primarily mass-load the panel member; or primarily provide additional damping to the panel member; or have the combined effect of mass-loading and damping the panel member. There is a greater tendency to reduce wanted acoustic output frequencies below those that otherwise would be attainable without modification (due to drum-like vibration) by adding a mainly mass-effective mass than by adding mainly damping-effective material or using holes.

Suitable affixed mainly mass-effective means, which may be small, typically fraction of a gram, will serve as a load that reduces efficiency of bending involved in drum-like vibration, thus at least reducing amplitude of unwanted high frequency acoustic components of drumming. Size of the affixed mass should not be more than achieves acceptable compromise between desired reduction of unwanted high frequencies and inevitable accompanying reduction of adjacent wanted frequencies.

There is another advantageous use for typically similarly small added/affixed masses in the control of otherwise at least potentially overly excited acoustic output frequencies, namely at feasible but unused in-board preferential driver coupling locations, with the useful effect for the acoustic output of the panel member that it is beneficially quieted and smoother. This is, of course, applicable both with and without other control(s) hereof in relation to drumming, and thus of independent inventive merit.

Suitable affixed mainly damping-effective material, usually of small to smallest possible mass, but say up to what might otherwise now feasibly further be effective as affixed mass, will serve by stretching and contracting to absorb energy in and of bending for drum-like vibration. The size/bulk of the affixed damping material need not be more than enough to dissipate desired/useful amount of energy, thus reduction of amplitude of high drumming frequencies, feasibly with such small mass as to have little or virtually no effect on adjacent wanted acoustic output frequencies. Typical damping material will be of light-weight elastomeric nature.

There are further advantageous uses for affixing of elastomeric material to the panel member. One is where damping material basically for effect on drumming as above is such that, or is associated with a driver configured such that, the material is or can usefully be sandwiched between a driver part (typically magnet pole-piece), and surface of the panel member within the driver coupling (typically voice coil), and with or without some operatively useful degree of effectively pre-compression. The other is where such elastomeric material in sandwiched relation with driver part and panel member surface serves in suspension of that driver part, typically requiring damping/spring compliance hitherto provided by spring means, whether as wholly or partially replacing or augmenting such known provision.

BRIEF DESCRIPTION OF THE DRAWINGS

Exemplary specific implementation for the invention is described relative to and diagrammatically illustrated in the accompanying drawings, in which:

FIGS. 1A, B, C are partial views respectively in perspective for part of a panel member, in section with outline voice coil, and in plan for hole size options for a distributed mode loudspeaker;

DESCRIPTION OF ILLUSTRATED EMBODIMENTS

Figure 2A:
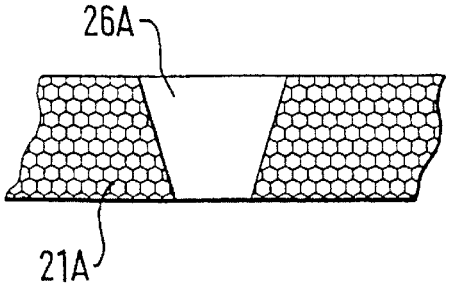
FIGS. 2A, B are partial sectional views of variant apertured panel members.

In FIGS. 1A, B, C loudspeaker 10 has a panel member 11 with a magnet-and-moving coil type driver 12 coupled thereto for causing bending wave action and corresponding acoustic output according to driver energisation. The driver 12 is shown with its moving voice coil 13 connected end-on to the panel member 11 for reciprocation relative to the magnet and pole-piece assembly 14/15 of the driver 12, thus push-pull action in launching bending wave in the panel member 11. The panel member 11 is shown with a parallel-sided through-hole 16 and the voice coil 13 on a peripheral margin 17 about the hole 16. FIG. 1B has dashed indication 15E of pole-piece 15 extended partially into the hole 16. FIG. 1C has indications of different hole sizes 16A, B, C, D corresponding to less than the full matching of area within confines of the voice coil 13.

Figure 2B:
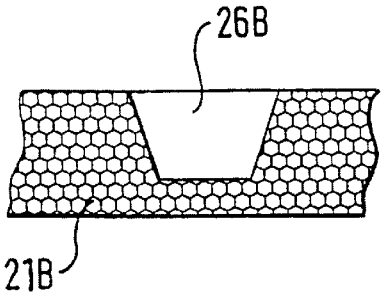

FIGS. 2A and 2B show variant aperturing of the panel member 21 as tapered through-hole 26A and tapered blind hole 26B respectively. Generally, holes local to driver coupling positions usefully reduce effective stiffening that can otherwise result from rigidity and/or reinforcing effect of affixed moving driver part(s), and further afford an edge from which bending wave vibration tends to be significantly more freely launched into the panel member. Any adverse effects, such as of a diffraction type, can be countered by material entrant the hole, say as addition on or as extension of the driver's magnetic assembly.

Figure 3:
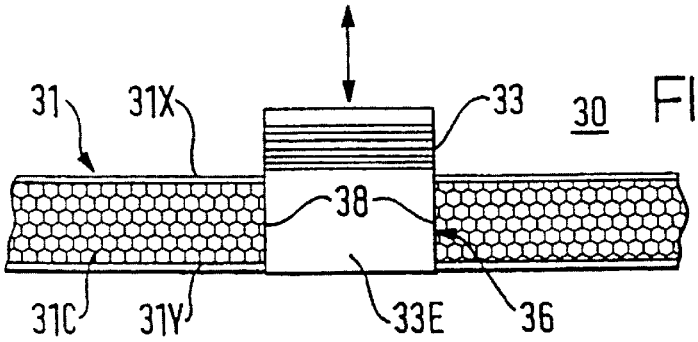
FIGS. 3 and 4 are partial sectional views of other embodiments with extension(s) into panel member holes.
Figure 4:
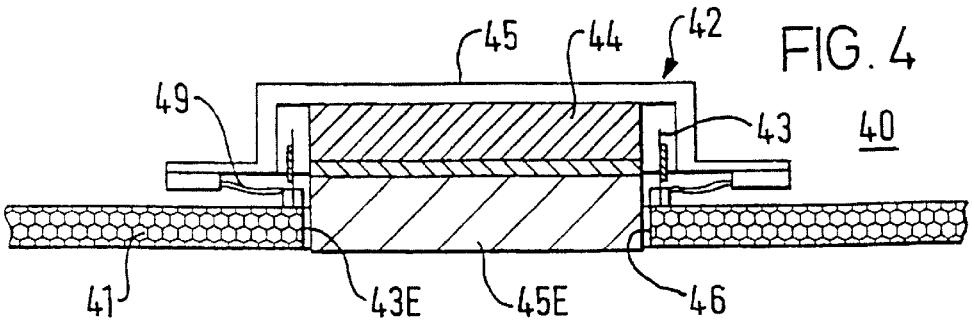

FIGS. 3, 4 show variant embodiments of loudspeakers 30, 40 in which panel members 31, 41 have associated driver voice coils 33, 43 coupled relative to through-holes 36, 46 of the panel member 31, 41. In FIG. 3, the hole 36 is shown occupied by extension 33E of the driver voice-coil 33, actually extended fully through full thickness of the panel member 31, i.e. to flush with outer skin 31Y of a cored (31C) and skinned (31X, Y) sandwich structure, and bonded in place (38) over its side. In FIG. 4, there is also extension 45E of the driver pole-piece 45, again shown fully through thickness of the panel member 41.

Figure 5A:
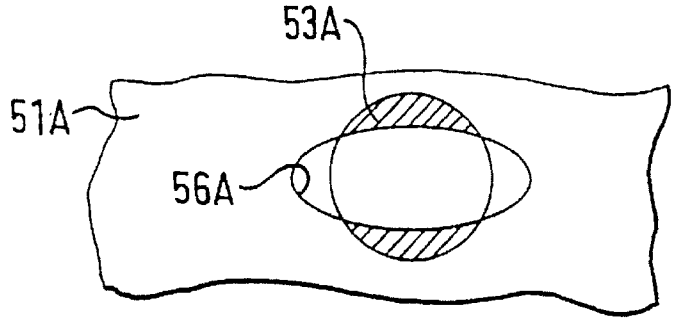
FIGS. 5A, B, C, D are partial outline plan views of cross-sectional mis-matching of driver part and panel member hole for their spaced inter-connection.
Figure 5C:
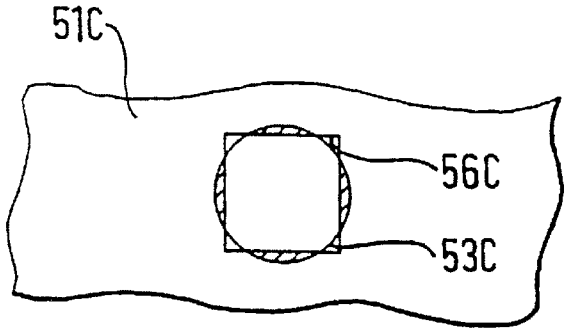
Figure 5B:
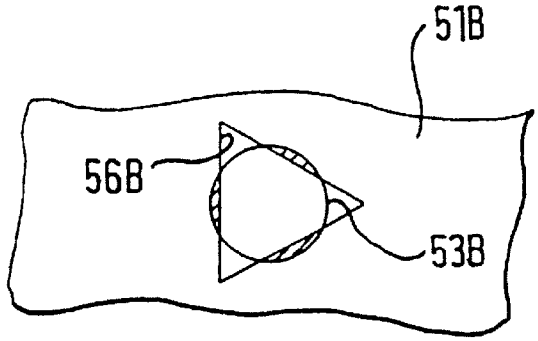
Figure 5D:
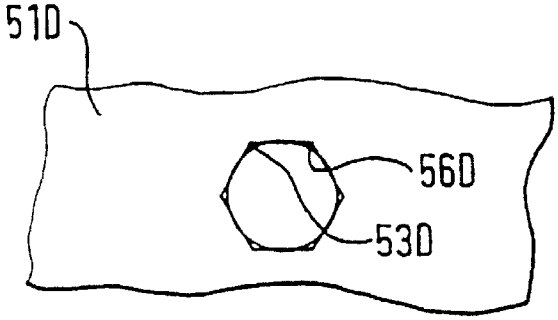

FIGS. 5A,B,C,D show how respective holes 56A,B,C,D of partly lesser and partly greater size/extent than ends of moving driver, usually voice coil, parts 53A,B,C,D enable provision of two, three, four or more connections of such part in coupling to the panel member 51A,B,C,D—specifically for circular part ends 53A,B,C,D and oval, triangular, square and polygonal holes 56A,B,C,D. Variations involving corners/apices or rounded formations are obvious.

Figure 6:
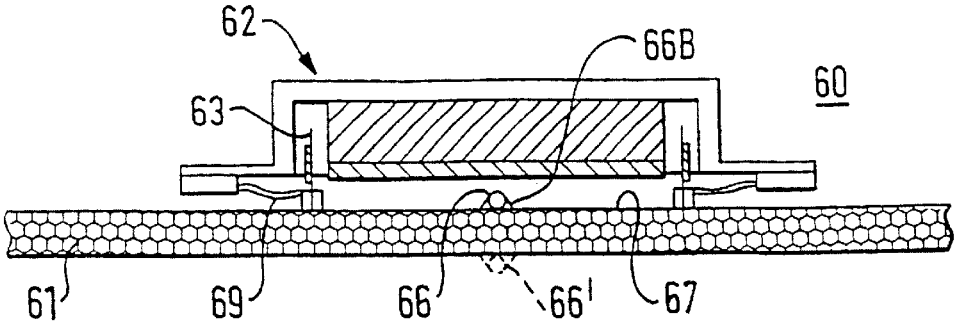
FIGS. 6 and 7 are partial sectional views of further embodiments using additional mass or damping affixed to the panel member within the driver coupling.

FIG. 6 shows unapertured panel member 61 with driver 62 drive-coupled by its voice coil 63 and included area 67 of the panel member bearing affixed localised mass 66, say bonded (66B) thereto. This mass will typically be small, usually fraction of a gram, say from about 0.1 to less than about 0.5 gram, but sufficient in practice to load and reduce amplitude of drumming.

Figure 7:
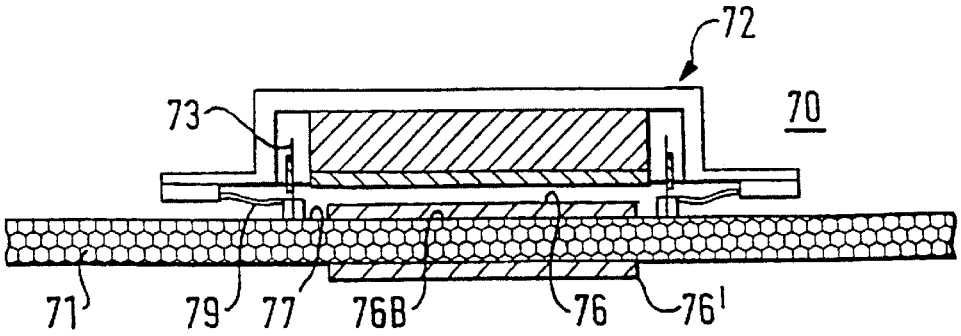

FIG. 7 also shows similar relation of unapertured panel member 71 and driver 72 with voice coil 73 included panel member area 77 bearing affixed localised damping material 76, say bonded (76B) thereto. This damping material 76 is preferably elastomeric of sufficient size and bulk to absorb as much energy as desired or practical in its stretching and contracting with attempted drum-like vibration of the area 77. Usually the damping material 76 is of much smaller mass than used for mass loading as in FIG. 6, but could be of the same order up to similar value for combining damping absorption and mass loading effects. FIGS. 6 and 7 both have dashed indications 66' and 76' for alternative or additional mass loading or damping at other side of the panel members 61, 71—as can also be effective and may be preferred.

Figure 8:
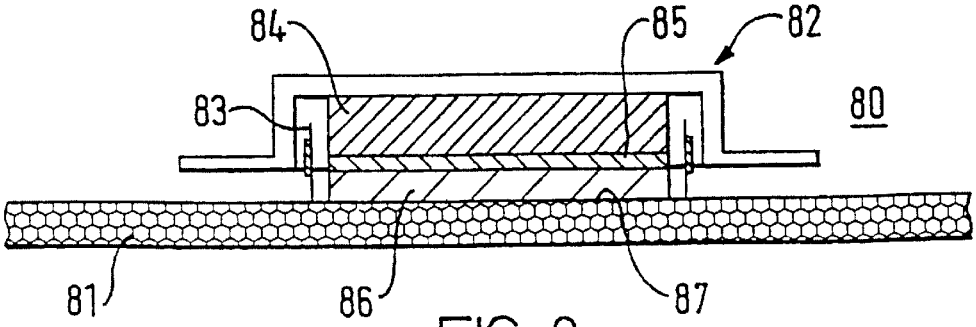
FIG. 8 is a partial sectional view showing sandwiched elastomeric damping and/or suspension.

FIG. 8 shows match of thickness of space 87 between the driver pole-piece 85 and the included panel surface and damping material 86 and space 87. This matching of thickness may be after some desired degree of precompression of elastomeric damping material, as can aid achieving desired damping and/or combined mass-loading. Moreover, useful contribution to required compliant suspension of the driver magnet assembly 84/85 can arise where the damping material 86 is structurally suitable for such further use, see additional indication 86A' of further bonding also to the pole-piece 85, and omission of spring suspension shown at 19, 49, 69, 79 of FIGS. 1, 4, 6, 7.

Figure 9A:
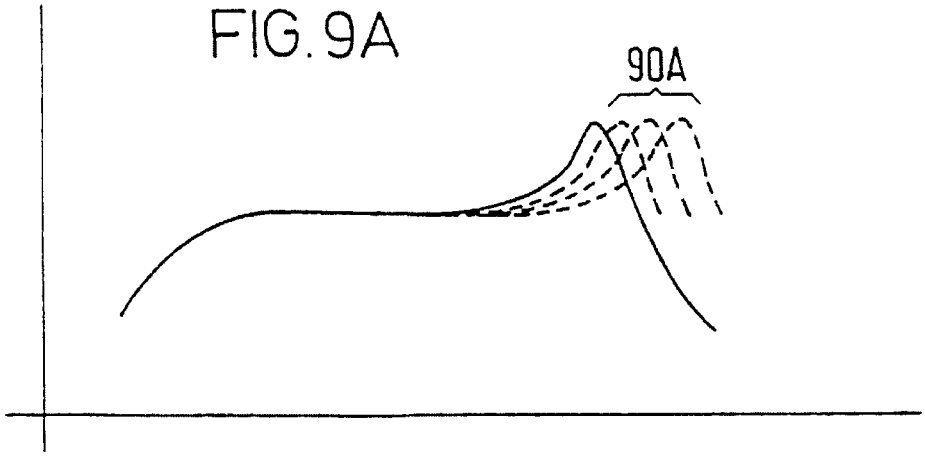
FIGS. 9A, B, C are idealised graphical indications of effects of holes of various sizes, added mass and added damping material, respectively, local to driver coupling.
Figure 9B:
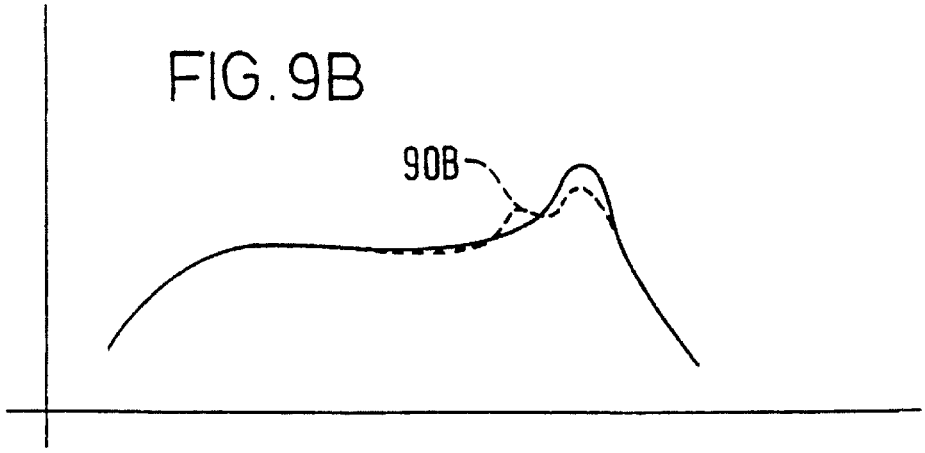
Figure 9C:
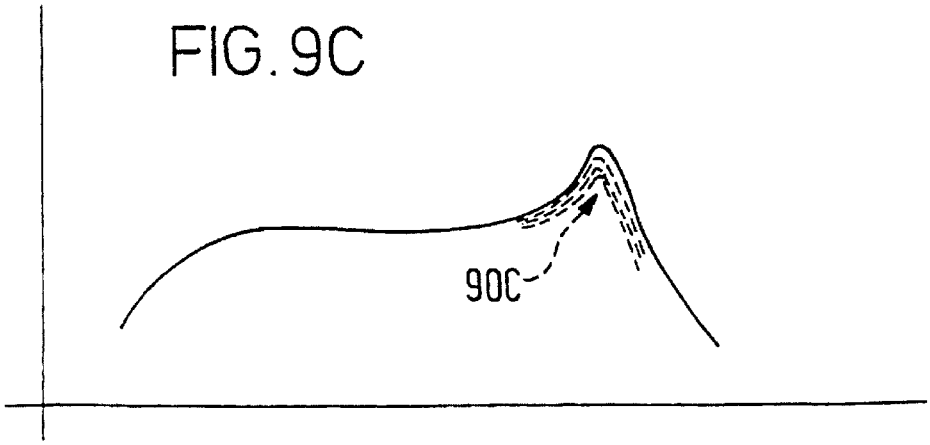

Idealised FIGS. 9A–C show typical effects for holes, mass-loading and damping local to driver coupling to acoustically active panel members of a distributed mode loudspeakers. Specifically, holes generally result in upward displacement of high frequency uplift attributable to drumming, and are so effective according to size, see dashed at 90A; mass-loading generally results in reducing that uplift, possibly change shape and splitting/spreading it often with slight lowering for adjacent wanted frequencies, see at 90B; and damping generally also resulting in reduction for unwanted high frequencies usually with little or no displacement and/or effect on adjacent wanted frequencies.

It is to be appreciated that seeming superiority of damping over mass-loading was achieved by experimentation directed to near as possible isolation of respective effects, and that practical materials will usually involve more of a joint contribution.

Figure 10A:
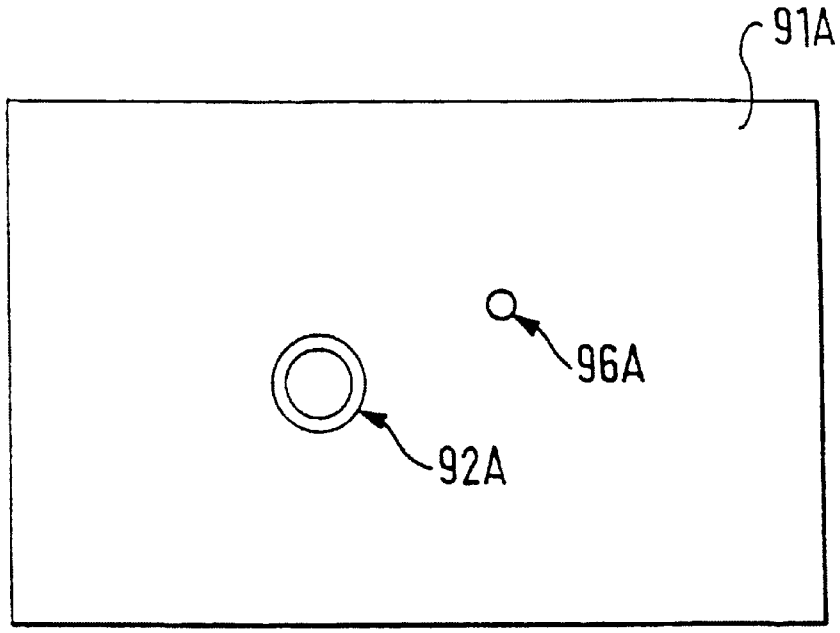
FIGS. 10A, B are outline plan views showing added mass affixed at such as unused feasible driver locations.
Figure 10B:
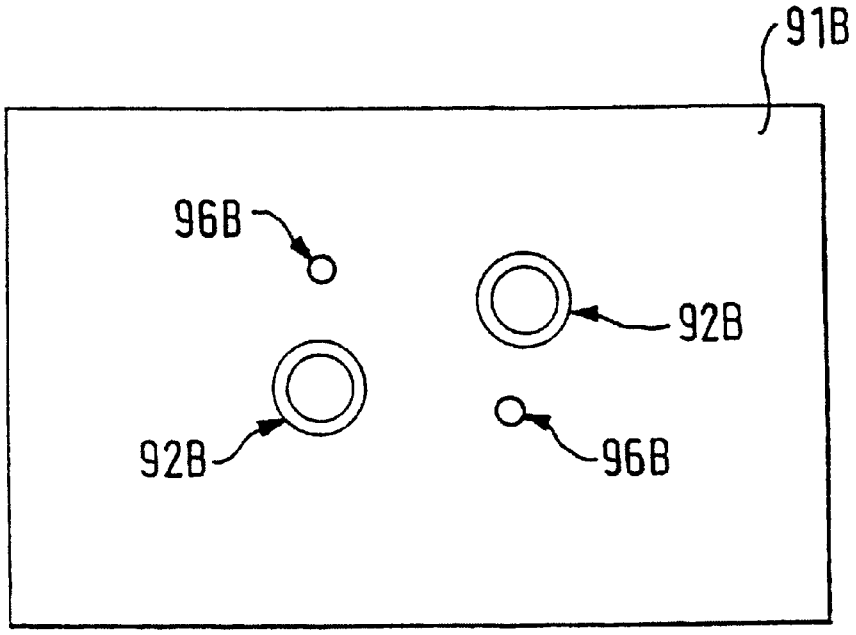

FIGS. 10A, B show other application of suitable usually light localised mass-loading. Panel members 91A, B have drivers 92A, B at preferential eccentric in-board excitation location(s) as generally known from above PCT and other prior patent applications by New Transducers Limited. For some panel structures capable of desired acoustic performance reliant on bending wave action, whether of core-and-skins type or monolithic composite type (to which above holes, mass-loading and damping are also applicable locally of the or each driver), there is such modal vibrational activity at other positions, perhaps particularly at unused preferential driver locations, as to benefit from some degree of quieting and modification resulting from use thereat of localised mass-loading, see at "mirror image" unused driver position(s) 96A, B.

The invention can be seen as usefully residing in and providing various features and combinations thereof, such as a hole at the drive unit position to control bending stiffness local to the driver, including creating an "edge" within the driver coupling area and reducing the driven mass at the drive position; control of such as diffraction effects caused by the hole using materials added to the drive unit, or even the panel member; fitting moving part(s) of drive unit(s), typically voice coil(s), right through the thickness of resonant panel members; mass-loading or damping to either or both sides of resonant panel members local to drive units; and mass-loading at other localised positions benefiting from resulting quieting and/or the phantom bending wave source effects within the overall panel area.

What is claimed is:

1. Loudspeaker comprising:

a panel member as a resonant acoustic radiator having physical characteristics such that the panel member can undergo resonant bending wave vibration when excited, a driver having a voice coil attached to a surface of the panel member so as to define a voice coil area, the driver also having a magnet assembly suspended from said surface of the panel member outside of said voice coil area, the driver causing resonant bending waves in the panel member, and a hole provided in the panel member, locally of the driver, the hole altering the mass and/or bending capability of the panel member locally of the driver and thereby upwardly displace high frequency uplift attributable to drumming of the zone of the panel member in the voice coil area.

2. Loudspeaker according to claim 1, wherein the hole is of constant cross-section throughout its depth into the thickness of the panel member.

3. Loudspeaker according to claim 2, wherein the cross-section of the hole is less than the area of the voice coil by an extent related to resultant effective raising of unwanted high frequency components.

4. Loudspeaker according to claim 2, wherein the driver is of magnet-and-moving coil type and has a pole piece extending into the hole.

5. Loudspeaker according to claim 1, wherein the voice coil is mounted on the panel around the circumference of the hole.

6. Loudspeaker according to claim 5, wherein the driver is of magnet-and-moving coil type and has a pole piece extending into the hole.

7. Loudspeaker according to claim 1, wherein the hole is of cross-section that mismatches the area over which the voice coil is coupled to the panel member to facilitate spaced connections between the voice coil and the panel member.

8. Loudspeaker according to claim 7, wherein the driver is of magnet-and-moving coil type and the voice coil of the driver has said spaced connections about the hole.

9. Loudspeaker according to claim 7, wherein the driver has a pole piece extending into the hole.

10. Loudspeaker according to claim 1, wherein the driver is of magnet-and-moving coil type and the voice coil includes a former extending into the hole in the panel member.

11. Loudspeaker according to claim 10, wherein the voice coil former extends throughout the thickness of the panel member.

12. Loudspeaker according to claim 11, wherein the driver has a pole piece extending into the hole.

13. Loudspeaker according to claim 10, wherein the driver has a pole piece extending into the hole.

14. Loudspeaker according to claim 1, wherein the driver is of magnet-and-moving coil type and has a pole piece extending into the hole.

15. Loudspeaker according to claim 1, wherein the voice coil is coupled to a first side of the panel member, and the zone of which the high frequency resonant acoustic output components are altered comprises a second, opposite side of the panel member in the voice coil area.

16. Loudspeaker according to claim 1, wherein the voice coil is wholly and exclusively coupled to a first side of the panel member.

17. Loudspeaker comprising:

a panel member as a resonant acoustic radiator having physical characteristics such that the panel member can undergo resonant bending wave vibration when excited, a driver having a voice coil attached to a surface of the panel member so as to define a voice coil area, the driver also having a magnet assembly suspended from said surface of the panel member outside of said voice coil area, the driver causing resonant bending waves in the panel member, and additional mass provided on the panel member locally of the driver, on at least one side of the panel member, for altering the mass and/or bending capability of the panel member locally of the driver and thereby reduce high frequency uplift attributable to drumming of the zone of the panel member in the voice coil area.

18. Loudspeaker according to claim 17, wherein the locally altered mass and/or bending capability of the panel member is substantially within the area of the coupling of the driver to the panel member.

19. Loudspeaker according to claim 18, wherein the locally altered mass and/or bending capability of the panel member is substantially concentric with the driver.

20. Loudspeaker according to claim 19, wherein the driver is of magnet-and-moving coil type.

21. Loudspeaker according to claim 19, wherein said additional mass primarily mass-loads the panel member.

22. Loudspeaker according to claim 19, wherein said additional mass primarily provides additional damping to the panel member.

23. Loudspeaker according to claim 22 wherein said additional mass comprises elastomeric material sandwiched between a pole-piece of the driver and a surface of the panel member.

24. Loudspeaker according to claim 23, wherein the damping means serves in compliant suspension of the driver relative to the panel member.

25. Loudspeaker according to claim 19, wherein the panel member has additional mass at at least one other position spaced away from the driver.

26. Loudspeaker according to claim 19, wherein said additional mass mass-loads the panel member and provides additional damping to the panel member.

27. Loudspeaker according to claim 17, wherein said additional mass primarily mass-loads the panel member.

28. Loudspeaker according to claim 17, wherein said additional mass primarily provides additional damping to the panel member.

29. Loudspeaker according to claim 17, wherein said additional mass mass-loads the panel member and provides additional damping to the panel member.

30. Loudspeaker according to claim 17, wherein the voice coil is coupled to a first side of the panel member, and the zone of which the high frequency resonant acoustic output components are altered comprises a second, opposite side of the panel member in the voice coil area.

31. Loudspeaker according to claim 17, wherein the voice coil is wholly and exclusively coupled to a first side of the panel member.

* * * * *